US008534471B2

(12) United States Patent
Wong et al.

(10) Patent No.: US 8,534,471 B2
(45) Date of Patent: Sep. 17, 2013

(54) HEIGHT ADJUSTMENT DEVICE FOR A DISHWASHER RACK

(75) Inventors: Chong Bin Wong, Vernon Hills, IL (US); Luca Gennaretti, Turin (IT)

(73) Assignee: Illinois Tool Works Inc., Glenview, IL (US)

( * ) Notice: Subject to any disclaimer, the term of this patent is extended or adjusted under 35 U.S.C. 154(b) by 96 days.

(21) Appl. No.: 13/322,418

(22) PCT Filed: Apr. 23, 2010

(86) PCT No.: PCT/US2010/032154

§ 371 (c)(1), (2), (4) Date: Nov. 23, 2011

(87) PCT Pub. No.: WO2010/138262

PCT Pub. Date: Dec. 2, 2010

(65) Prior Publication Data

US 2012/0082507 A1 Apr. 5, 2012

Related U.S. Application Data

(60) Provisional application No. 61/181,810, filed on May 28, 2009.

(51) Int. Cl.
*A47L 15/50* (2006.01)

(52) U.S. Cl.
USPC ..... 211/41.8; 312/351

(58) Field of Classification Search
USPC ..... 211/41.8, 41.9, 175, 181.1, 207–208; 134/137, 58 D, 200–201, 56 D, 57 D, 57 DL, 134/144, 176; 312/311, 351, 334.4, 350, 312/228.1, 333, 236, 215, 222; 248/408, 248/423, 297.31, 297.2, 295.1; D32/2, 3, D32/53

See application file for complete search history.

(56) References Cited

U.S. PATENT DOCUMENTS

| | | | | | |
|---|---|---|---|---|---|
| 3,472,573 | A | * | 10/1969 | Geiger | 312/351 |
| 3,726,580 | A | * | 4/1973 | Guth | 312/351 |
| 3,726,581 | A | * | 4/1973 | Doepke | 312/351 |
| 3,744,646 | A | * | 7/1973 | Duncan et al. | 211/162 |
| 3,809,450 | A | * | 5/1974 | Guth | 312/351 |
| 3,809,451 | A | * | 5/1974 | Pitstick | 312/351 |
| 3,822,085 | A | * | 7/1974 | Clark | 312/351 |
| 3,892,453 | A | * | 7/1975 | Daily | 312/351 |
| 4,064,887 | A | * | 12/1977 | Geiger et al. | 134/144 |

(Continued)

OTHER PUBLICATIONS

ISR for PCT/US2010/032154 dated Oct. 20, 2010.

*Primary Examiner* — Jennifer E Novosad
(74) *Attorney, Agent, or Firm* — Mark W. Croll; Paul F. Donovan

(57) ABSTRACT

Embodiments of the present invention provide a system for adjusting a height of a rack within a dishwasher. The system includes a rack plate assembly and a wheel plate assembly. The rack plate assembly is configured to be secured to the rack. The rack plate assembly includes a rack plate and a handle pivotally secured to the rack plate. The wheel plate assembly is adjustably secured with respect to the rack plate. The wheel plate assembly includes a wheel plate having at least one adjustment slot. A portion of the handle securely engages the wheel plate through the at least one adjustment slot. The portion of the handle is configured to disengage from the at least one adjustment slot in order to adjust the rack plate with respect to the wheel plate.

17 Claims, 9 Drawing Sheets

(56) References Cited

U.S. PATENT DOCUMENTS

| | | | | |
|---|---|---|---|---|
| 4,097,099 | A * | 6/1978 | Spiegel | 312/311 |
| 5,044,666 | A * | 9/1991 | Griesemer | 280/801.2 |
| 5,474,378 | A * | 12/1995 | Smith et al. | 312/334.4 |
| 5,595,200 | A * | 1/1997 | Favaro | 134/201 |
| 5,657,878 | A * | 8/1997 | Austin | 211/41.8 |
| 5,860,716 | A | 1/1999 | Good et al. | |
| 6,247,771 | B1 * | 6/2001 | Miller | 312/310 |
| 6,974,040 | B2 * | 12/2005 | Jahrling | 211/41.8 |
| 7,032,604 | B2 * | 4/2006 | Welch | 134/135 |
| 7,410,228 | B2 * | 8/2008 | Dickson et al. | 312/311 |
| 7,731,805 | B2 * | 6/2010 | Banta et al. | 134/56 D |
| 7,775,378 | B2 | 8/2010 | Tynes et al. | |
| 8,191,560 | B2 * | 6/2012 | Mallory et al. | 134/145 |
| 8,192,557 | B2 * | 6/2012 | Ryu et al. | 134/56 D |
| 2004/0103932 | A1 * | 6/2004 | Kim | 134/137 |
| 2005/0001524 | A1 * | 1/2005 | Deiss et al. | 312/334.4 |
| 2005/0039782 | A1 * | 2/2005 | Kim | 134/58 D |
| 2006/0119236 | A1 * | 6/2006 | Dickson et al. | 312/311 |
| 2006/0237042 | A1 * | 10/2006 | Weaver et al. | 134/25.2 |

* cited by examiner

HEIGHT ADJUSTMENT DEVICE FOR A DISHWASHER RACK

RELATED APPLICATIONS

This application is national phase of PCT/US2011/032154 filed Apr. 23, 2011, and claims priority benefits from U.S. Provisional Patent Application No. 61/181,810 entitled "Dish Washer Rack Height Adjuster System," filed May 28, 2009.

FIELD OF EMBODIMENTS OF THE INVENTION

Embodiments of the present invention generally relate to a system and method for adjusting a height of a rack, and more particularly, to a system and method for adjusting a height of a rack within an automatic dishwasher.

BACKGROUND

Automatic dishwashers are used to clean dishes, cutlery, glassware, and the like. A typical dishwasher includes a main housing having an internal washing chamber and a door that provides access to the internal washing chamber. At least one rack is slidably supported within the internal washing chamber. The rack may be slid out of the chamber so that a user may position items to be cleaned therein. The user then slides the rack back into the chamber and closes the door in order to begin the cleaning process.

The height of the rack within the washing chamber may be adjusted in order to accommodate items of varying shapes and sizes. For example, the rack may be adjusted downwardly with respect to an upper surface of the washing chamber in order to allow large glasses, such as Pilsner glasses, to be safely positioned within the washing chamber. Typically, the height-adjusting system is a complicated assembly that requires a plurality of fasteners, such as screws, to hold the height-adjusting system to the rack.

SUMMARY OF EMBODIMENTS OF THE INVENTION

Certain embodiments of the present invention provide a system for adjusting a height of a rack within a dishwasher. The system includes a rack plate assembly and a wheel plate assembly.

The rack plate assembly is configured to be secured to the rack. The rack plate assembly includes a rack plate and a handle pivotally secured to the rack plate.

The wheel plate assembly is adjustably secured with respect to the rack plate. The wheel plate assembly includes a wheel plate having at least one adjustment slot. A portion of the handle securely engages the wheel plate through the at least one adjustment slot. The portion of the handle is configured to disengage from the at least one adjustment slot in order to adjust the rack plate with respect to the wheel plate.

The rack plate assembly may also include a biasing spring that biases the handle so that the portion of the handle securely engages the wheel plate through the at least one adjustment slot in a secured position. The handle is configured to be engaged to remove the at least one adjustment slot from the secured position.

The biasing spring may be a coil spring, leaf spring, or the like. The biasing spring may include a curved support beam integrally connected to a rack beam through a resilient joint.

The curved support beam may be cradled within a portion of the handle. The rack beam may be pivotally secured to a portion of the rack plate.

The wheel plate assembly may include at least one wheel rotatably secured to the wheel plate. The wheel(s) is configured to be positioned within a wheel track of the dishwasher.

The rack plate may also include at least one rack-securing member configured to snapably secure to a portion of the rack. The rack plate may be configured to be secured to the rack without the use of separate and distinct fasteners, such as screws or bolts. Instead, the rack plate may secure to the rack through integral structures of the rack plate.

The rack plate may also include upper and lower stop members that prevent the rack plate assembly from dislodging from the wheel plate assembly.

Certain embodiments of the present invention provide a system that includes a rack plate assembly and wheel plate assembly, similar to those described above. The rack plate may include a rack plate having a finger slot and a handle pivotally secured to the rack plate. The handle may include a finger tab protruding through the finger slot in a secured position.

The wheel plate assembly may include a wheel plate having at least two adjustment slots. The finger tab securely engages the wheel plate through one of the two adjustment slots at any one time in the secured position. The handle is configured to be engaged in order to remove the finger tab from a slot in order to adjust the rack plate with respect to the wheel plate.

Figure 1:
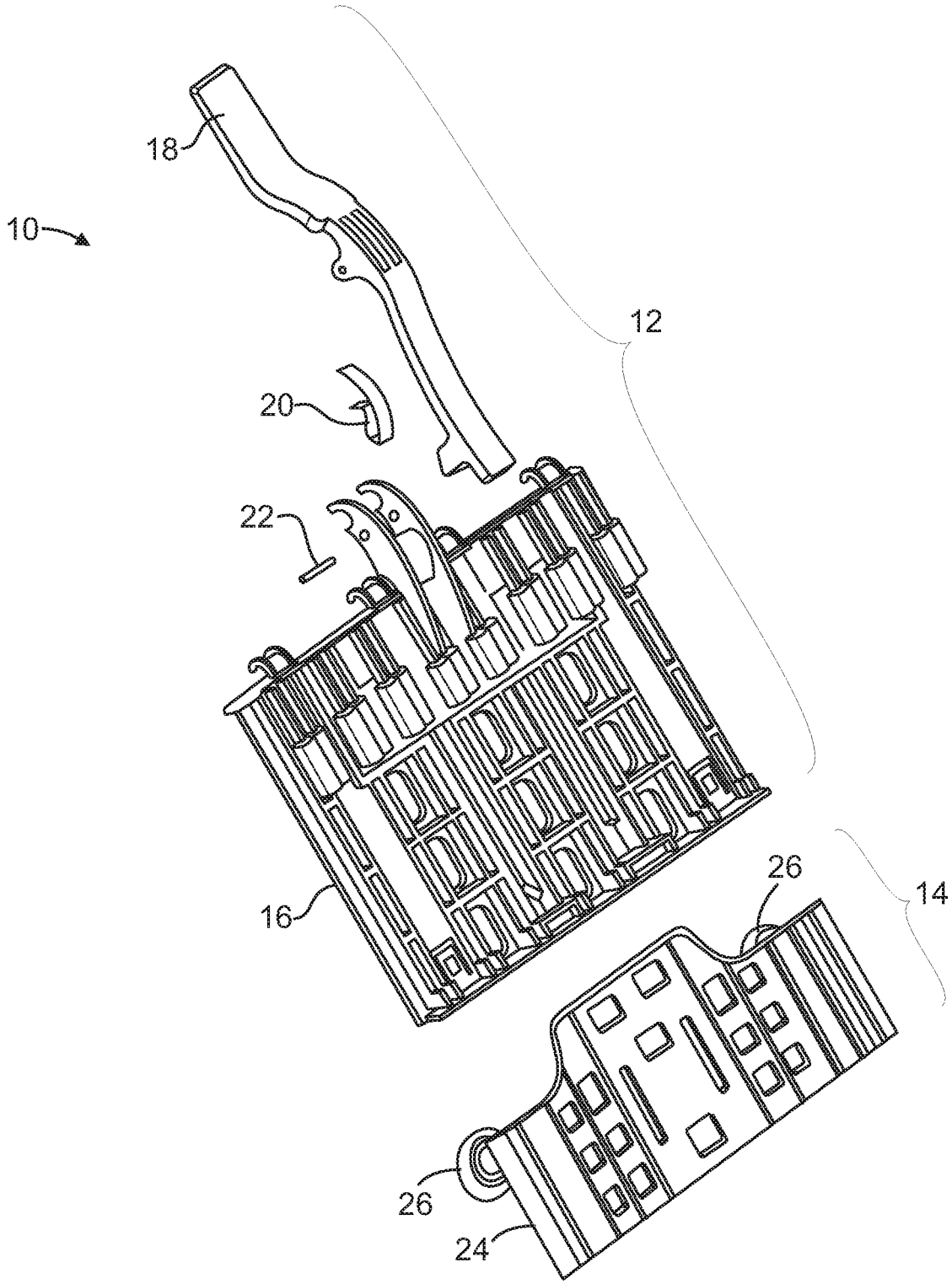
FIG. 1 illustrates an isometric exploded view of a rack height adjustment system, according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

FIG. 1 illustrates an isometric exploded view of a rack height adjustment system 10, according to an embodiment of the present invention. The system 10 includes a rack plate assembly 12 and a wheel plate assembly 14. The rack plate assembly 12 includes a rack plate 16, a handle 18, a biasing spring 20, and a pin 22. The wheel plate assembly 14 includes a wheel plate 24 and wheels 26.

Figure 2:
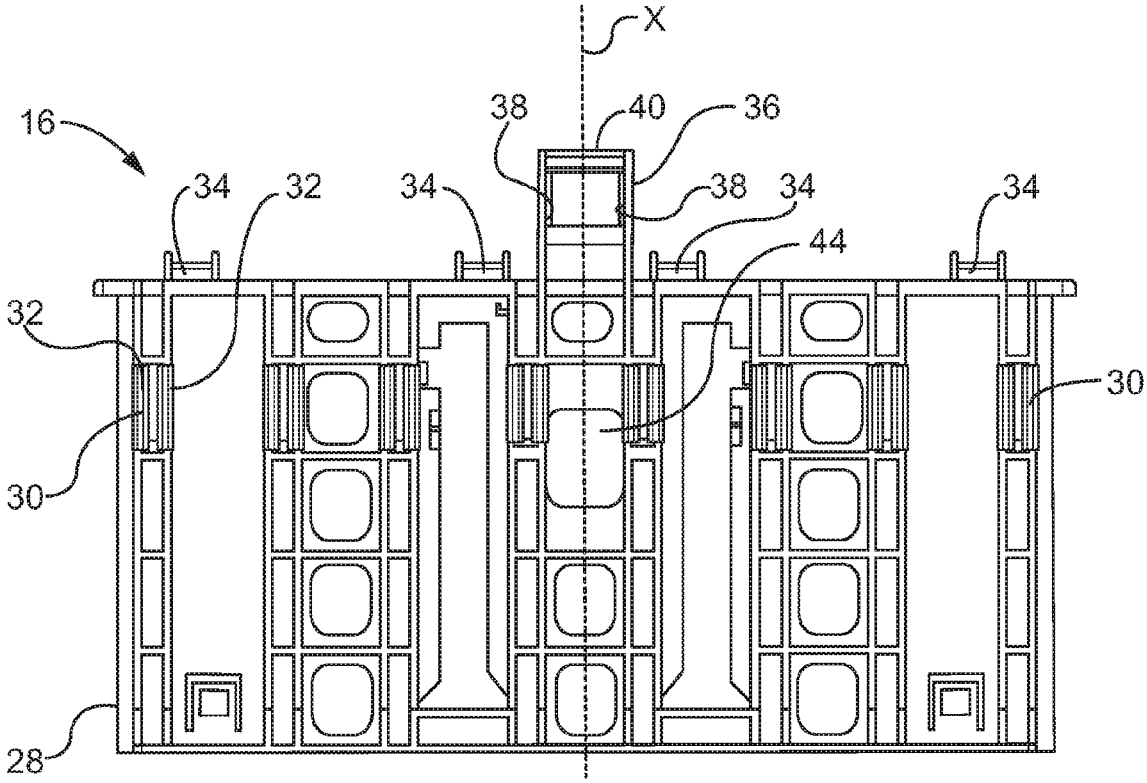
FIG. 2 illustrates a rear view of a rack plate, according to an embodiment of the present invention.

FIG. 2 illustrates a rear view of the rack plate 16. The rack plate 16 includes a main planar body 28 having a plurality of rack-securing members 30 extending outwardly therefrom. The rack-securing members 30 may include opposing cylindrical clasps 32 configured to snapably secure a vertical rack post of a dishwasher rack (not shown in FIG. 2) in a space between the clasps 32. Optionally, the rack-securing members 30 may be clamps, slots, tabs, or various other mechanisms configured to secure to a rack post.

A plurality of clasps 34 may also extend from an upper edge of the main planar body 28. The clasps 34 are configured to engage a horizontal support bar of a dishwasher rack (not shown in FIG. 2). Thus, the rack-securing members 30 and the clasps 34 ensure that the rack plate 16 is secured to a dishwasher rack.

A handle-engaging beam 36 extends from an upper edge of the main planar body 28 and is aligned with a central vertical axis x of the rack plate 16. As shown in FIG. 2, the handle-engaging beam 36 is between two clasps 34 and is generally centered with respect to the vertical axis x. Optionally, the handle-engaging beam 36 may be located at various other positions.

The handle-engaging beam 36 includes parallel support posts 38 connected by an upper horizontal connecting bar 40. Additionally, a finger slot 44 is formed through the planar body 28 below the handle-engaging beam 36.

Figure 3:
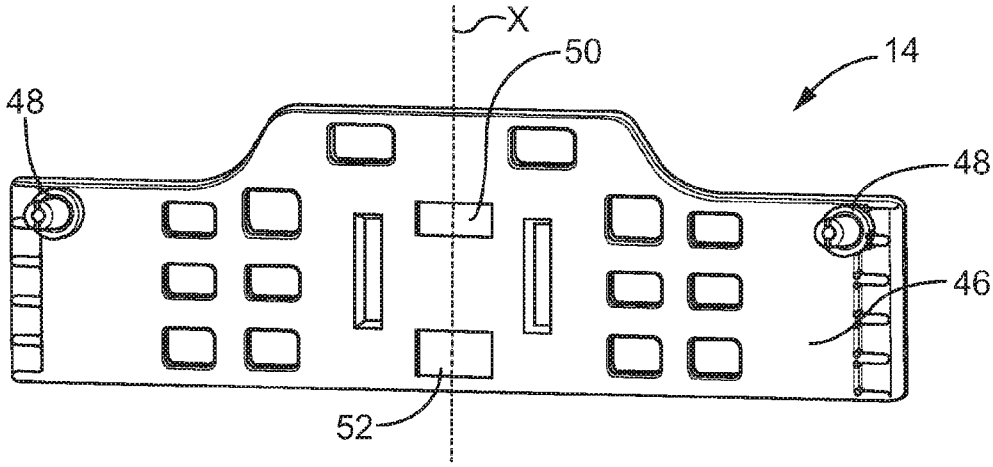
FIG. 3 illustrates a front view of a wheel plate, according to an embodiment of the present invention.

FIG. 3 illustrates a front view of the wheel plate 14. The wheel plate 14 includes a main planar body 46 having two wheel-engaging posts 48 extending outwardly therefrom. The wheel-engaging posts 48 may be split posts with outer expanded portions. Accordingly, the wheel-engaging posts 48 may be squeezed together and expanded when wheels are mounted thereon, as noted infra.

A plurality of aligned adjustment slots 50 and 52 are aligned with respect to a central vertical axis x of the wheel plate 14. The slots 50 and 52 are configured to adjustably retain a portion of the handle 18 (shown in FIG. 1) at different positions.

Figure 4:
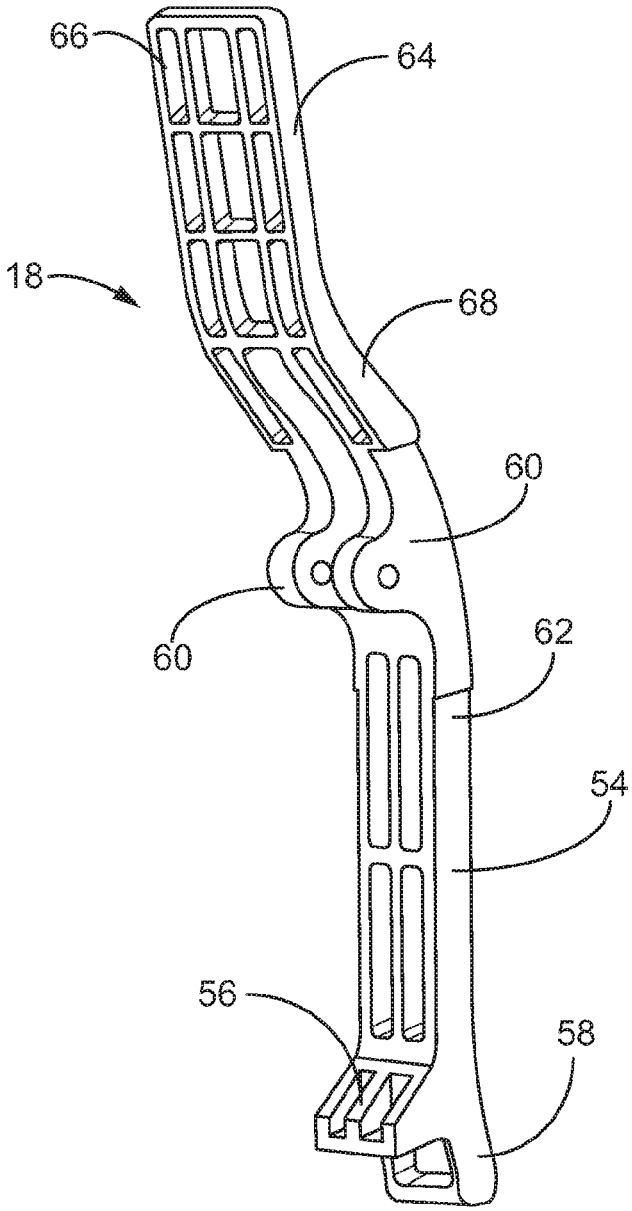
FIG. 4 illustrates an isometric front view of a handle, according to an embodiment of the present invention.

FIG. 4 illustrates an isometric front view of the handle 18. The handle 18 includes a main strap 54 having a finger tab 56 outwardly extending from a distal end 58, opposing pin support braces 60 extending from lateral edges of the main strap 54 proximate an intermediate area 62, and an engaging beam 64 at a proximal end 66 of the main strap 54. As shown, the engaging beam 64 is integrally connected to the intermediate area 62 through a curved beam 68 that locates the engaging beam 64 at a different plane than the distal end 58 and the intermediate area 62.

Figure 5:
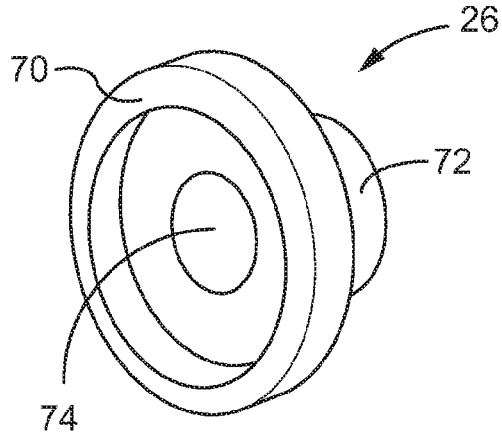
FIG. 5 illustrates an isometric front view of a wheel, according to an embodiment of the present invention.

FIG. 5 illustrates an isometric front view of a wheel 26. The wheel includes a bearing ring 70 integrally connected to a support post 72. A central channel 74 is formed through the bearing ring 70 and the support post 72.

Figure 6:
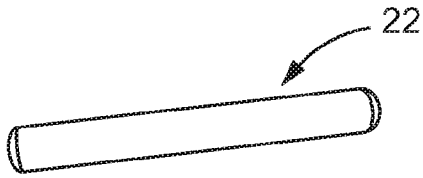
FIG. 6 illustrates an isometric front view of a pin, according to an embodiment of the present invention.

FIG. 6 illustrates an isometric front view of the pin 22. The pin 22 is generally an elongate cylindrical member.

Figure 7:
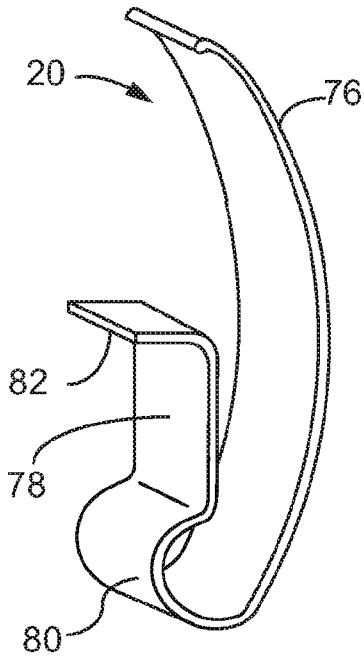
FIG. 7 illustrates an isometric front view of a biasing spring, according to an embodiment of the present invention.

FIG. 7 illustrates an isometric front view of the biasing spring 20. The biasing spring 20 includes a curved support beam 76 integrally connected to a rack beam 78 through a resilient joint 80. The rack beam 78 includes a clip 82 outwardly extending from a distal end. The resilient joint 80 allows the rack beam 78 and support beam 76 to flex toward one another when a squeezing force is applied and snap back to at-rest positions, as shown in FIG. 7, when the squeezing force is removed.

Figure 8:
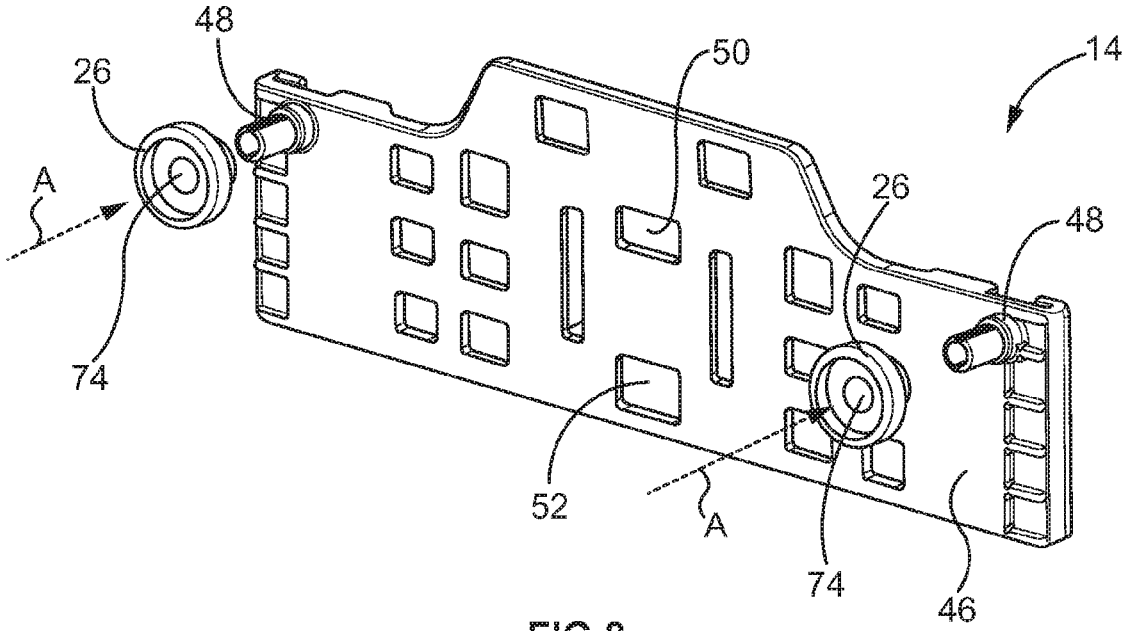
FIG. 8 illustrates an isometric front exploded view of a wheel plate assembly, according to an embodiment of the present invention.
Figure 9:
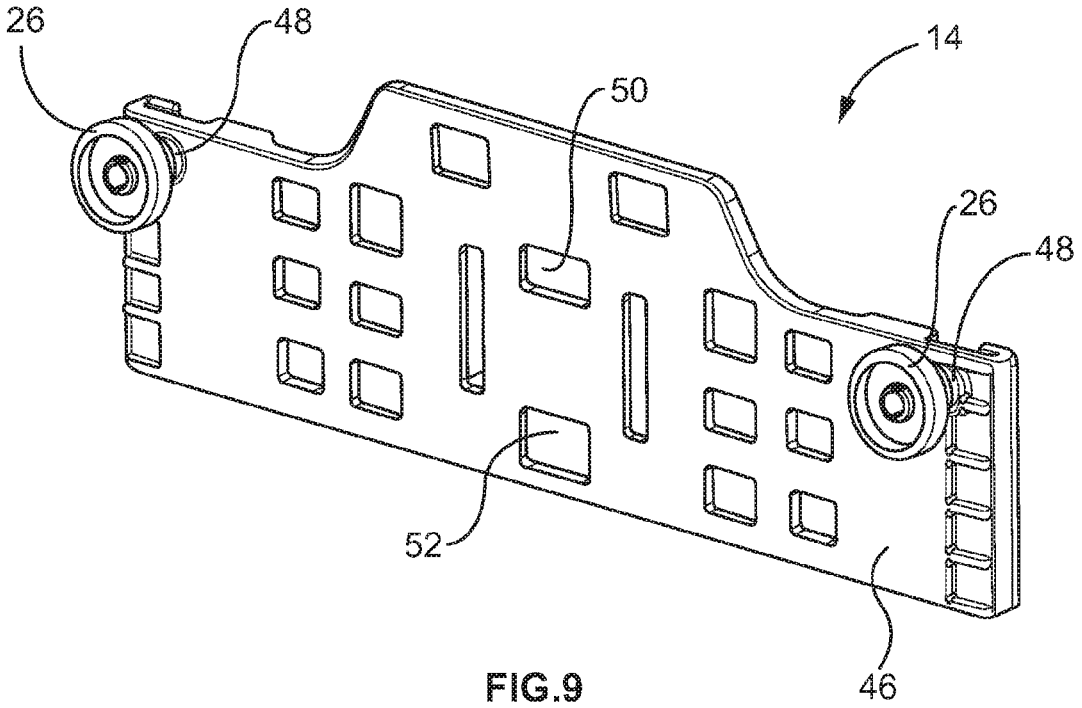
FIG. 9 illustrates an isometric front view of a wheel plate assembly, according to an embodiment of the present invention.

FIG. 8 illustrates an isometric front exploded view of the wheel plate assembly 14. FIG. 9 illustrates an isometric front view of the wheel plate assembly 14. Referring to FIGS. 8 and 9, in order to rotatably secure the wheels 26 to the posts 48, the central channels 74 of the wheels 26 are aligned with the posts 48. The wheels 26 are then urged toward the posts in the direction of arrows A (shown in FIG. 8). The wheels snapably and rotatably secure to the posts 48 when the expanded distal ends of the post flexingly expand after passing through the channels 74. The diameter of each expanded end is thus greater than the diameter of each central channel 74, while the diameter of each shaft of the posts 48 is less than the diameter of each central channel 74. Accordingly, the wheels 26 are secured to the posts 48, while at the same time able to rotate around the shafts of the posts 48.

Figure 10:
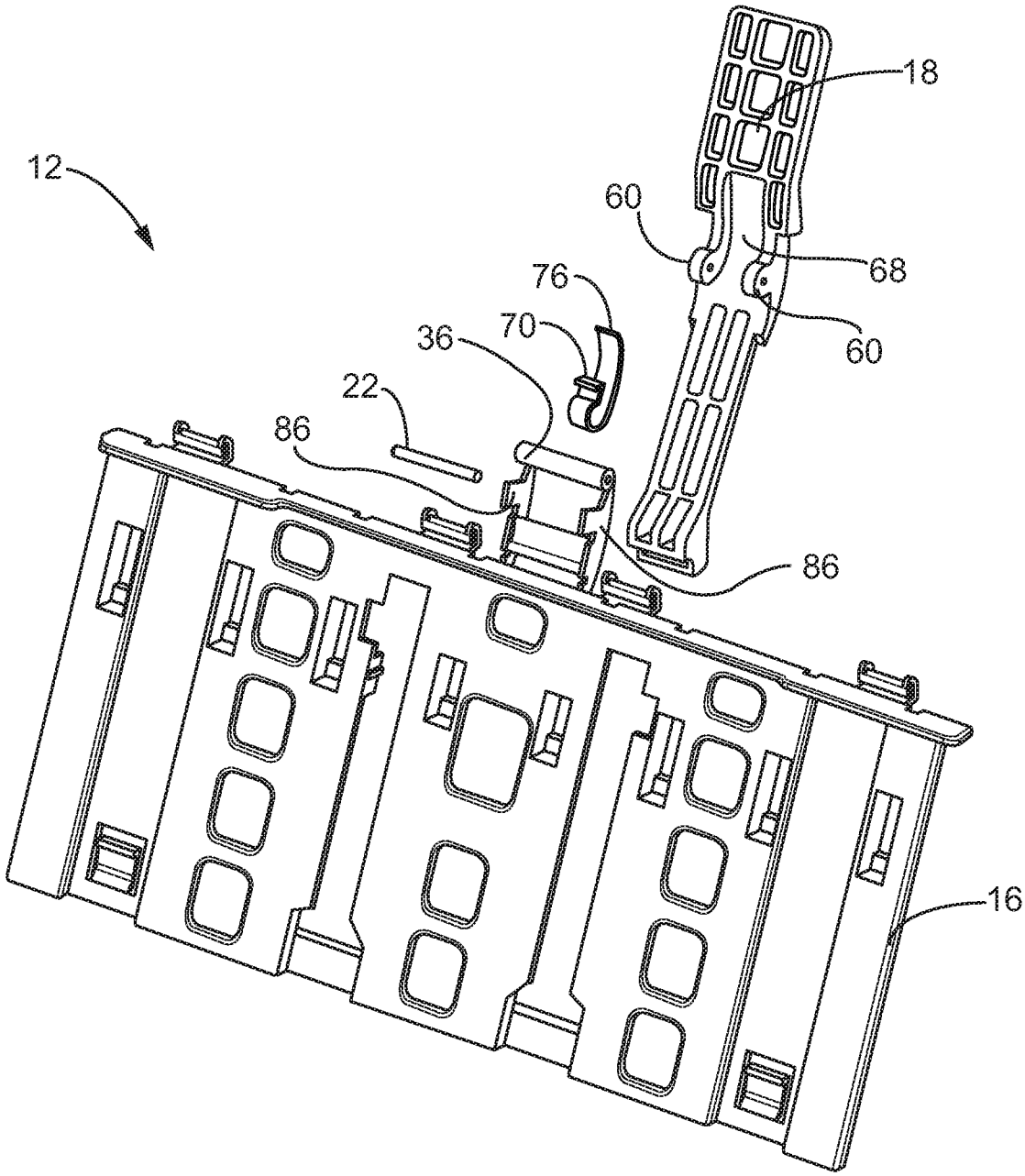
FIG. 10 illustrates an isometric front exploded view of a rack plate assembly, according to an embodiment of the present invention.

FIG. 10 illustrates an isometric front exploded view of the rack plate assembly 12. In order to secure the handle 18 to the rack plate 16, the curved support beam 76 of the biasing spring 20 is aligned with the curved beam 68 of the handle 18, which is configured to cradle the curved support beam 76. Additionally, the pin support braces 60 are aligned with pin supports 86 of the handle-engaging beam 36, such that pin holes formed through the pin support braces 60 are aligned with pin holes formed through the pin supports 86. The pin 22 is then aligned with the aligned holes, and is positioned therethrough.

Figure 11:
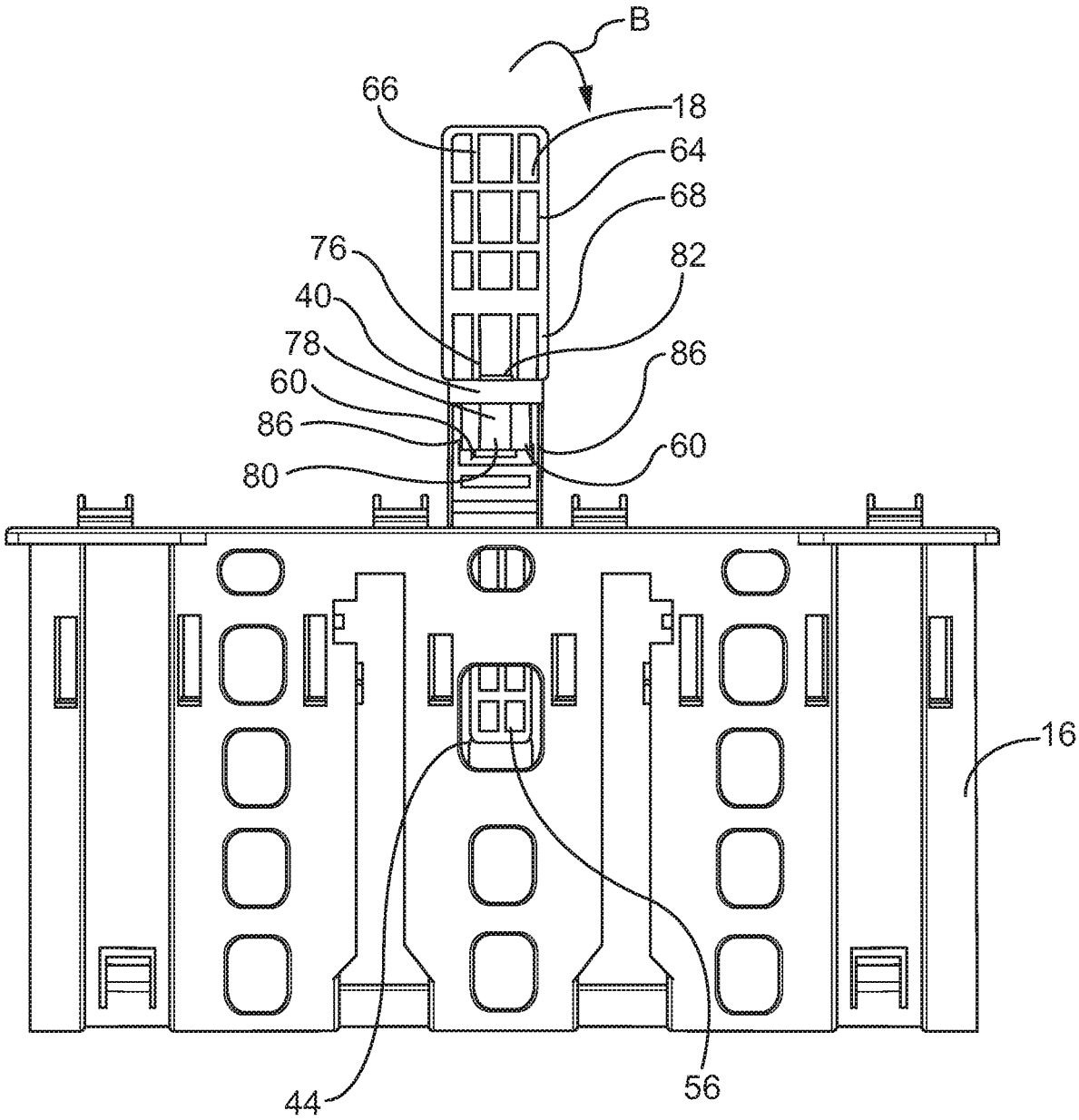
FIG. 11 illustrates a front view of a rack plate assembly, according to an embodiment of the present invention.

FIG. 11 illustrates a front view of the rack plate assembly 12. As shown, the curved support beam 76 is cradled within the curved beam 68 of the handle 18. The pin 22 (hidden from view) connects the pin support braces 60 to the pin supports 86. Thus, the handle 18 may pivot about this connection. Note, the pin 22 passes through an opening defined by the resilient joint 80 of the biasing spring 20.

The clip 82 of the biasing spring 20 mounts over the horizontal connecting beam 40, thereby exerting a biasing force into the beam 40. In this position, the biasing spring 20 ensures that the finger tab 56 is forced through the finger slot 44 of the rack plate 16

The engaging beam 64 may be grasped and pivoted forward in the direction of arc B. A user exerts sufficient force to overcome the biasing force of the biasing spring 20. In this manner, the finger tab 56 pivots out of the finger slot 44 in a direction opposite to arc B. Once the user disengages the engaging beam 64, the biasing spring 20 forces the handle 18 back to its at-rest position, with the finger tab 56 extending through the finger slot 44.

Figure 12:
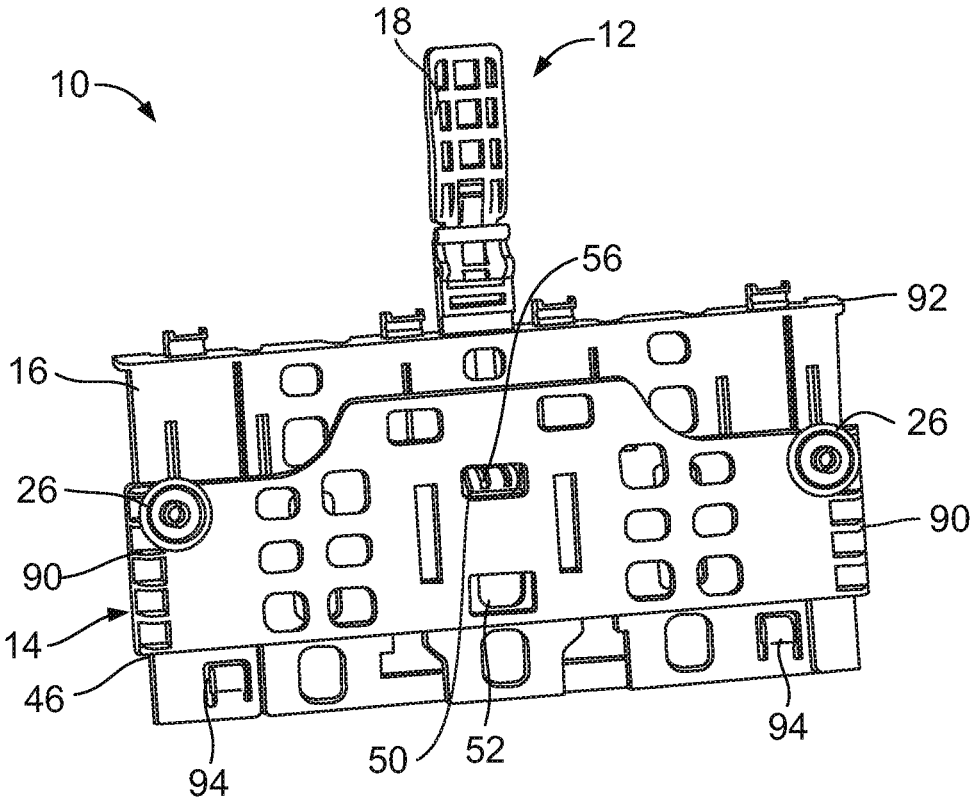
FIG. 12 illustrates a front view of a rack height adjustment system, according to an embodiment of the present invention.
Figure 13:
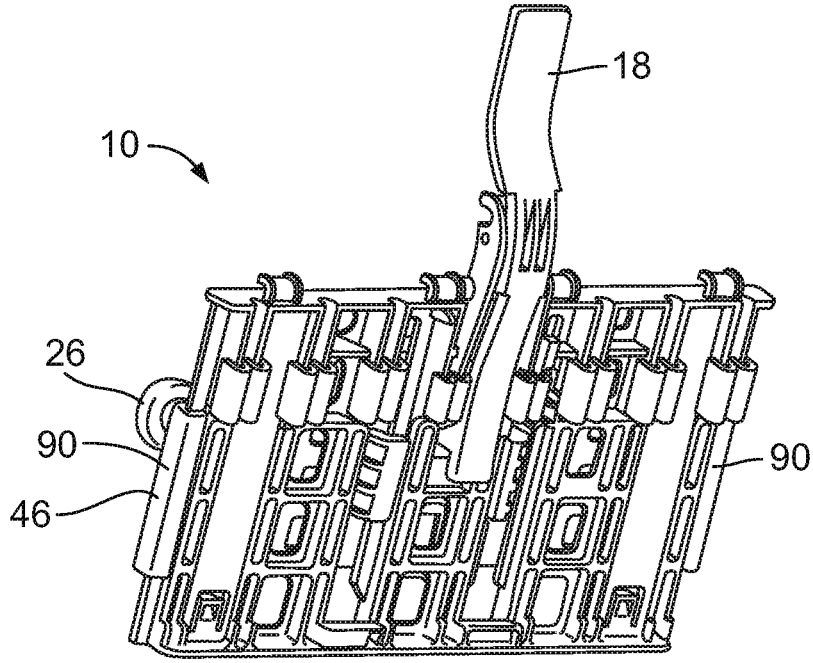
FIG. 13 illustrates a rear view of a rack height adjustment system, according to an embodiment of the present invention.
Figure 14:
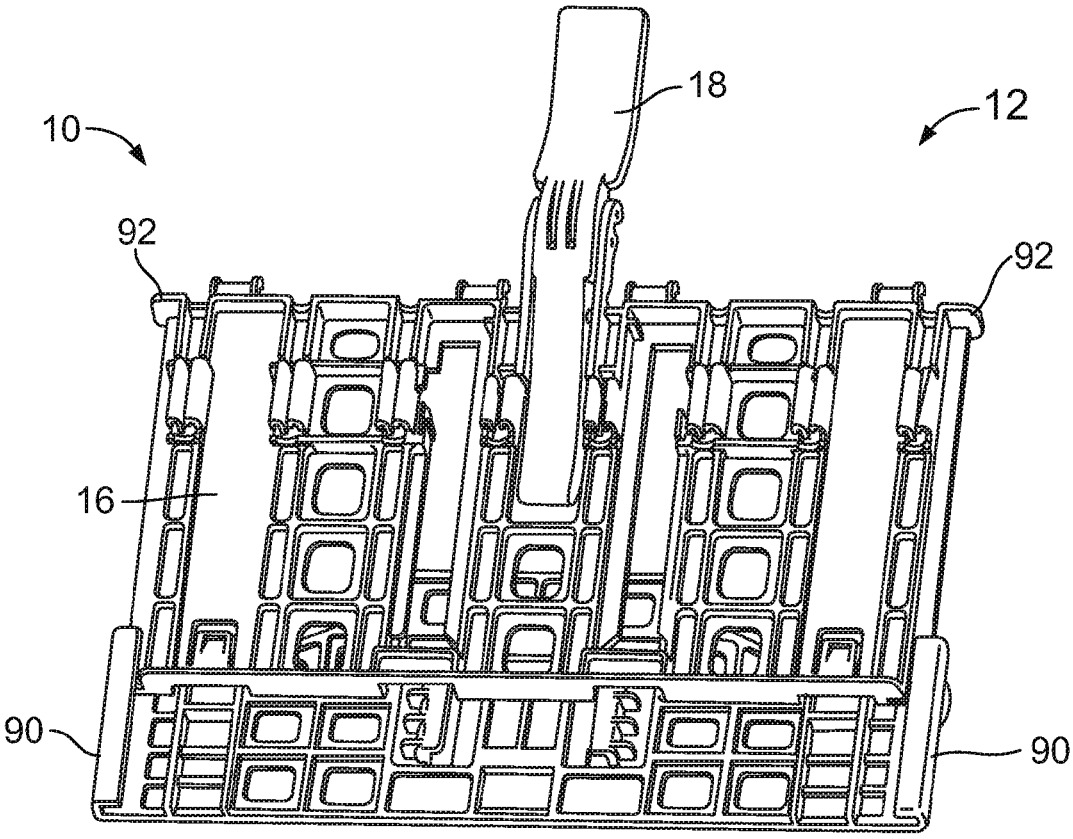
FIG. 14 illustrates an isometric rear view of a rack height adjustment system at a first position, according to an embodiment of the present invention.
Figure 15:
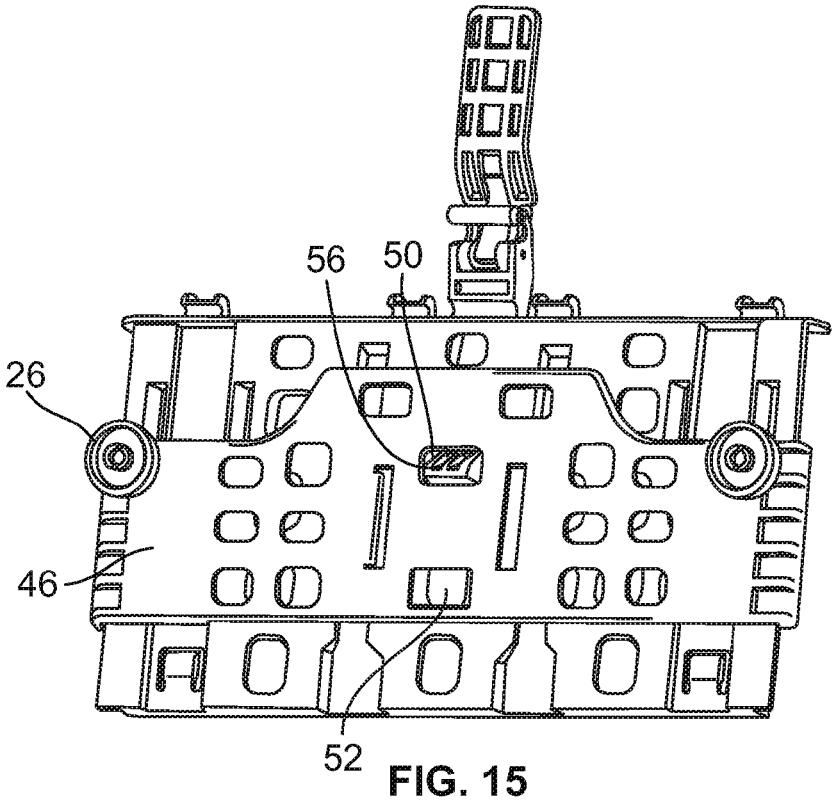
FIG. 15 illustrates an isometric front view of a rack height adjustment system at a second position, according to an embodiment of the present invention.

FIGS. 12 and 13 illustrate front and rear views, respectively, of the rack height adjustment system 10. FIGS. 14 and 15 illustrate isometric rear and front views, respectively, of the rack height adjustment system 10 at first and second positions, respectively. Referring to FIGS. 12-15, the wheel plate assembly 14 is secured to the rack plate assembly 12. The wheel plate assembly 14 includes lateral clamping members 90 that slidably secure around lateral edges of the rack plate 16. The wheel plate assembly 14 is secured in position by the finger tab 56 extending through the finger slot 44 of the rack plate 16 and an upper adjustment slot 50 of the main planar body 46 of the wheel plate assembly 14. Accordingly, the wheel plate assembly 16 is prevented from moving with respect to the rack plate assembly 12. However, when the handle 18 is engaged to remove the finger tab 56 from the finger slot 44 of the rack plate 16, the finger tab 56 also disengages from the upper adjustment slot 50, thereby allowing the rack plate assembly 12 to be moved with respect to the wheel plate assembly 14.

An upper ledge 92 prevents the wheel plate assembly 14 from upwardly dislodging from the rack plate assembly 12. Similarly, crimped lower tabs 94 provide a barrier past which the wheel plate assembly 14 is prevented from passing.

Accordingly, the rack plate assembly 12 may be adjusted with respect to the wheel plate assembly 14 by way of a user engaging the handle 18, as discussed supra. For example, a user may engage the handle 18, as noted, thereby removing the finger tab 56 from a secure engagement. The user then pushes or pulls the handle up or down to position the rack plate assembly 12 at a different position. When the desired height is located, the user allows the biasing spring 20 to bias the handle so that the finger tab 56 extends through a desired adjustment slot, thereby securing the rack plate assembly 12 at a desired height with respect to the wheel plate assembly 14. While two adjustment slots 50 and 52 are shown with respect to the wheel plate assembly 14, more or less adjustment slots may be used depending on the desired levels of rack adjustment.

Figure 16:
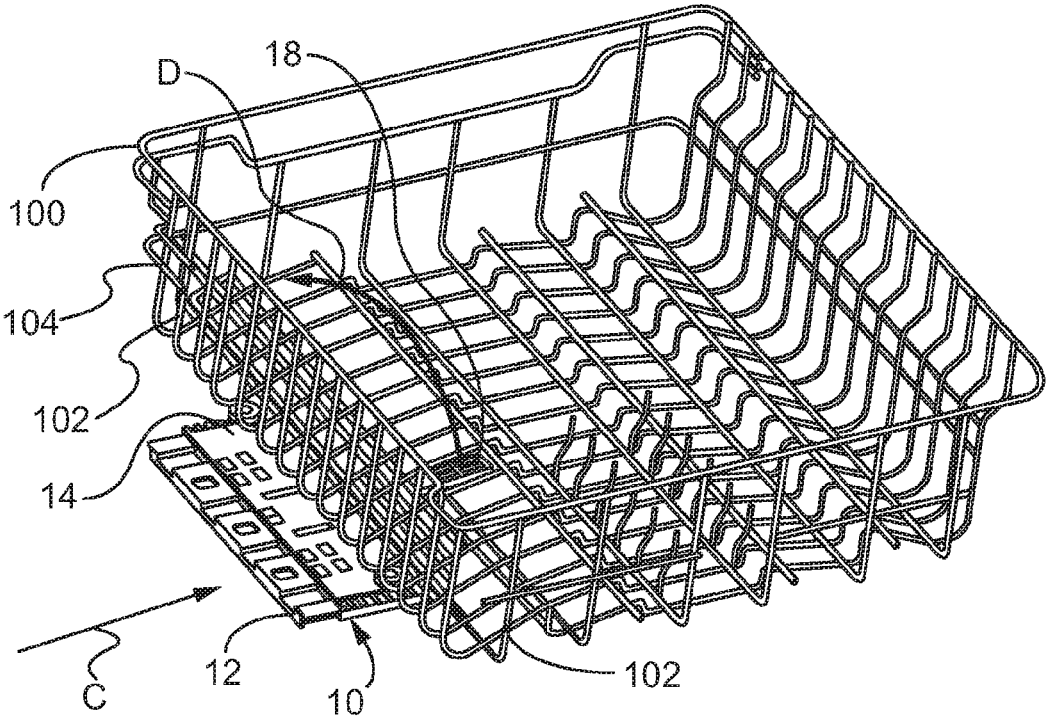
FIG. 16 illustrates an isometric top view of a rack height adjustment system being secured to a dishwasher rack, according to an embodiment of the present invention.

FIG. 16 illustrates an isometric top view of the rack height adjustment system 10 being secured to a dishwasher rack 100, according to an embodiment of the present invention. In order to secure the system 10 to the rack 100, the handle 18 is positioned between adjacent rack posts 102 and urged inwardly in the direction of arrow C. The handle 18 is then pivoted upwardly toward the outer lateral boundary of the rack 100 in the direction of arc D. In this position, the rack securing members 32 (shown in FIG. 2) are aligned with rack posts 102 and snapably secured thereto. Similarly, the clasps 34 (shown in FIG. 2) may similarly engage a horizontal cross bar 104 of the rack 100, thereby securing the rack plate assembly 12 to the rack 100.

Figure 17:
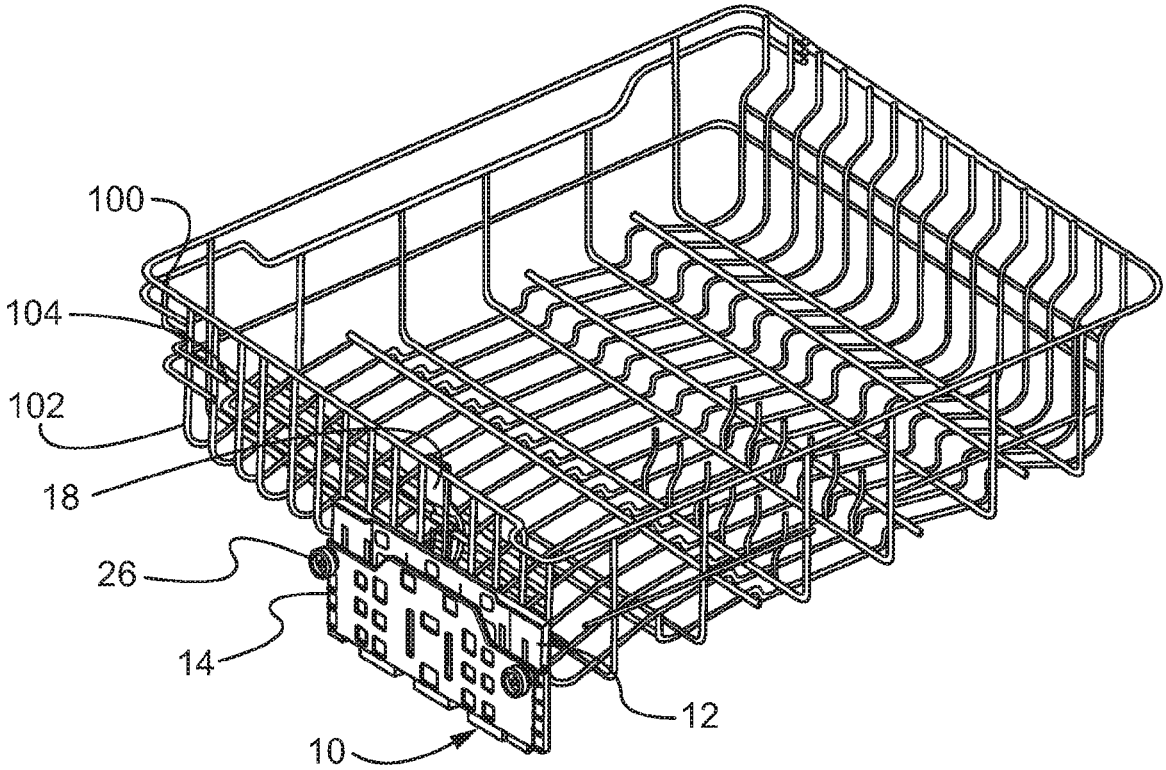
FIG. 17 illustrates an isometric top view of a rack height adjustment system secured to a dishwasher rack, according to an embodiment of the present invention.

FIG. 17 illustrates an isometric top view of the rack height adjustment system 10 secured to the dishwasher rack 100. The wheels 26 of the wheel plate assembly 14 are movably secured within a wheel track (not shown) of a dishwasher (not shown). Accordingly, the wheel plate assembly 14 remains at the same height within the dishwasher. The rack plate assembly 12 may, however, be adjusted relative to the wheel plate assembly 14, as discussed supra, thereby allowing the height of the rack 100, to which the rack plate assembly 12 is secured, to be adjusted.

Thus, embodiments of the present invention provide a rack height adjustment system 10 that is easy to manufacture and assemble. Further, unlike prior systems, the rack height adjustment system 10 does not require separate and distinct fasteners, such as screws, to secure the system 10 to the rack 100.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A system for adjusting a height of a rack within a dishwasher, the system comprising:

a rack plate assembly configured to be independently secured to the rack without the use of separate and distinct fasteners, wherein said rack plate assembly comprises a rack plate and a handle pivotally secured to said rack plate; and a wheel plate assembly adjustably secured with respect to said rack plate, wherein said wheel plate assembly comprises a wheel plate having at least one adjustment slot, wherein a portion of said handle securely engages said wheel plate through said at least one adjustment slot, and wherein said portion of said handle is configured to disengage from said at least one adjustment slot in order to adjust said rack plate with respect to said wheel plate.

2. The system of claim 1, wherein said rack plate assembly further comprises a biasing spring that biases said handle so that said portion of said handle securely engages said wheel plate through said at least one adjustment slot in a secured position, and wherein said handle is configured to be engaged to remove said at least one adjustment slot from the secured position.

3. The system of claim 2, wherein said biasing spring comprises a curved support beam integrally connected to a rack beam through a resilient joint, wherein said curved support beam is cradled within a portion of said handle, and said rack beam is pivotally secured to a portion of said rack plate.

4. The system of claim 1, wherein said wheel plate assembly comprises at least one wheel rotatably secured to said wheel plate, and wherein said at least one wheel is configured to be positioned within a wheel track of the dishwasher.

5. The system of claim 1, wherein said rack plate comprises at least one rack-securing member configured to snapably secure to a portion of the rack.

6. The system of claim 1, wherein said at least one adjustment slot comprises two adjustment slots.

7. The system of claim 1, wherein said rack plate comprises upper and lower stop members that prevent said rack plate assembly from dislodging from said wheel plate assembly.

8. A system for adjusting a height of a rack within a dishwasher, the system comprising:

a rack plate assembly configured to be secured to the rack, wherein said rack plate assembly comprises a rack plate having a finger slot and a handle secured to said rack plate to pivot about said rack plate away from the rack, wherein said handle comprises a finger tab protruding through said finger slot in a secured position; and a wheel plate assembly adjustably secured with respect to said rack plate, wherein said wheel plate assembly comprises a wheel plate having at least two adjustment slots, wherein said finger tab securely engages said wheel plate through one of said two adjustment slots in the secured position, and wherein said handle is configured to be engaged in order to remove said finger tab from said one of said two adjustment slots in order to adjust said rack plate with respect to said wheel plate.

9. The system of claim 8, wherein said rack plate assembly further comprises a biasing spring that biases said handle so that said finger tab securely engages said wheel plate through said one of said two adjustments slot in the secured position.

10. The system of claim 9, wherein said biasing spring comprises a curved support beam integrally connected to a rack beam through a resilient joint, wherein said curved support beam is cradled within a portion of said handle, and said rack beam is pivotally secured to a portion of said rack plate.

11. The system of claim 8, wherein said wheel plate assembly comprises two aligned wheels rotatably secured to said wheel plate, and wherein said two aligned wheels are configured to be positioned within a wheel track of the dishwasher.

12. The system of claim 8, wherein said rack plate comprises a plurality of rack-securing members configured to snapably secure to posts and/or cross-beams of the rack.

13. The system of claim 8, wherein said rack plate is configured to be secured to the rack without the use of separate and distinct fasteners.

14. The system of claim 8, wherein said rack plate comprises upper and lower stop members that prevent said rack plate assembly from dislodging from said wheel plate assembly.

15. A system for adjusting a height of a rack within a dishwasher, the system comprising:

a rack plate assembly configured to be secured to the rack, wherein said rack plate assembly comprises a rack plate having a finger slot, a handle pivotally secured to said rack plate, and a biasing spring, wherein said handle comprises a single beam aligned with a central vertical axis of said rack plate and a finger tab protruding through said finger slot in a secured position, wherein said rack plate comprises a plurality of rack-securing members configured to snapably secure to at least one of said posts and cross-beams of the rack, and wherein said biasing spring comprises a curved support beam integrally connected to a rack beam through a resilient joint, wherein said curved support beam is cradled within a portion of said handle, and said rack beam is pivotally secured to a portion of said rack plate; and a wheel plate assembly adjustably secured with respect to said rack plate, wherein said wheel plate assembly comprises a wheel plate having at least two adjustment slots, and two aligned wheels rotatably secured to said wheel plate, wherein said two aligned wheels are configured to be positioned within a wheel track of the dishwasher, wherein said finger tab securely engages said wheel plate through one of said two adjustment slots in the secured position, wherein said biasing spring biases said handle so that said finger tab securely engages said wheel plate through said one of said two adjustments slot in the secured position and wherein said handle is configured to be engaged in order to remove said finger tab from said one of said two adjustment slots in order to adjust said rack plate with respect to said wheel plate.

16. The system of claim 15, wherein said rack plate is configured to be secured to the rack without the use of separate and distinct fasteners.

17. The system of claim 15, wherein said rack plate comprises upper and lower stop members that prevent said rack plate assembly from dislodging from said wheel plate assembly.

* * * * *